United States Patent [19]

Swick

[11] Patent Number: 4,472,269

[45] Date of Patent: Sep. 18, 1984

[54] SLUICE BOX CLASSIFIER FOR GOLD MINING DREDGE

[75] Inventor: Thomas E. Swick, Portland, Oreg.

[73] Assignee: D & K Detector Sales, Inc., Portland, Oreg.

[21] Appl. No.: 399,786

[22] Filed: Jul. 19, 1982

[51] Int. Cl.[3] ..... B03B 7/00; B07B 1/04

[52] U.S. Cl. ..... 209/44; 209/240; 209/248; 209/490; 209/493

[58] Field of Search ..... 209/237, 447, 259, 273, 209/241, 247, 248, 44, 220, 471, 371, 375, 412, 173, 159, 240, 409, 417, 363, 243, 490, 492, 493

[56] References Cited

U.S. PATENT DOCUMENTS

| | | | |
|---|---|---|---|
| 520,113 | 5/1894 | Carstein | 209/240 |
| 881,767 | 3/1908 | Bostwick | 210/459 |
| 969,659 | 4/1909 | Sackett | 209/240 |
| 1,948,797 | 7/1932 | Nicolai | 209/447 |
| 2,091,620 | 11/1933 | Williams | 209/44 |
| 4,319,994 | 3/1982 | Morgan | 209/447 |

OTHER PUBLICATIONS

D & K Detector Sales Inc., *Catalog*, p. 18, 13809 S.E. Division, Portland, Oregon 97236.

"Jerry Keene's Gold in a Campground" Keene Engineering Inc., Northridge, Ca., pp. 17,38,47.

*Primary Examiner*—Frank W. Lutter
*Assistant Examiner*—Wm. Bond
*Attorney, Agent, or Firm*—Klarquist, Sparkman, Campbell, Leigh & Whinston

[57] ABSTRACT

A sluice box classifier for a sluice box of a gold mining dredge includes a trough and a rim secured to an underside of the trough. The rim anchors the trough to a standard size container. The trough is formed of four walls and a bottom, and is at least as wide as a lower end portion of the sluice box from which collected overburden is received. The bottom includes a center panel and two floor panels which slope upwardly from opposite sides of the center panel to meet opposite sidewalls of the trough. The floor panels funnel overburden deposited into the trough from the sluice box to the center panel where a plurality of openings in the center panel allows the smaller pieces of overburden to pass through into the container. A portion of a front wall of the trough is bent outwardly of the trough to cooperate with an angle member so as to form a slot which connects the trough to the sluice box.

1 Claim, 3 Drawing Figures

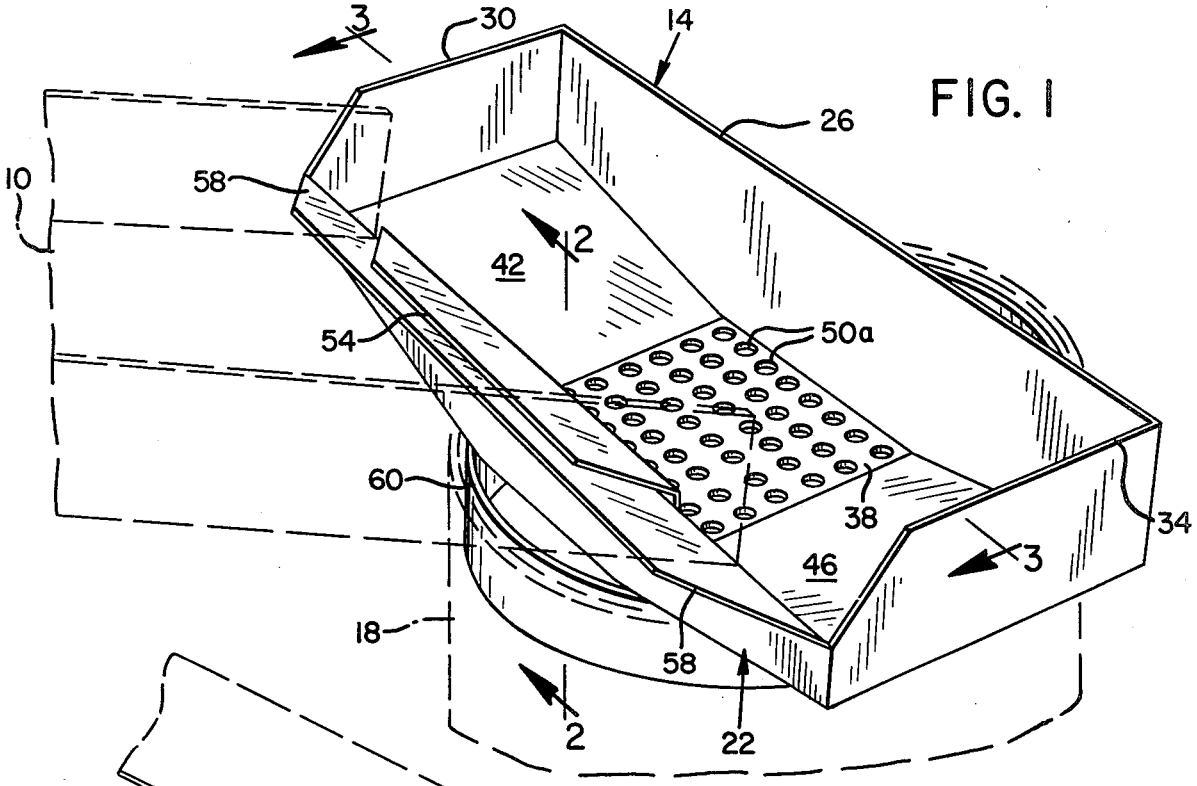
FIG. 1
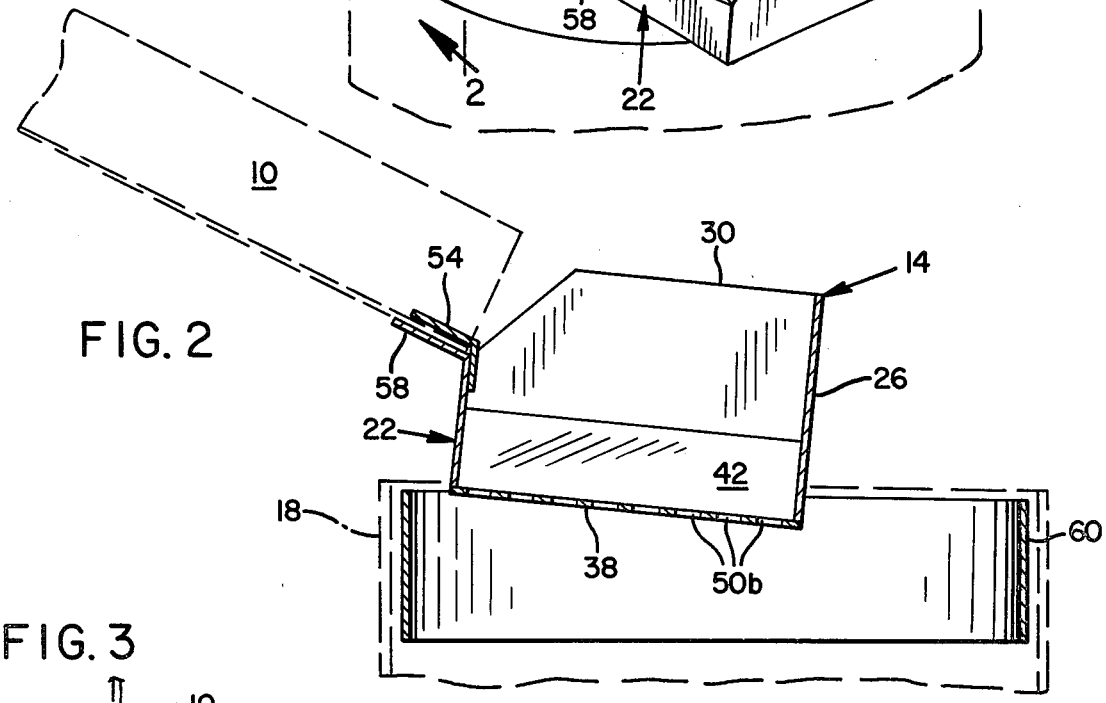
FIG. 2
FIG. 3
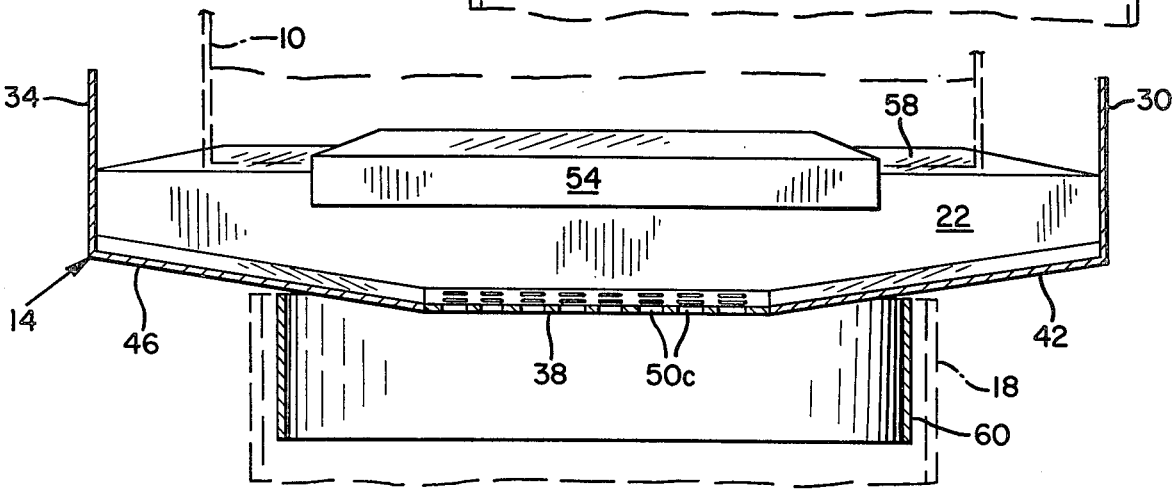

SLUICE BOX CLASSIFIER FOR GOLD MINING DREDGE

BACKGROUND OF THE INVENTION

This invention relates generally to dredging equipment and more particularly to apparatus used in conjunction with a sluice box of a gold mining dredge.

Gold prospectors searching for surface gold typically use a gold mining dredge to pick up and collect loose overburden (gravel, sand, gold nuggets, etc.) found near stream beds and the like. The collected overburden is panned for gold. A standard dredge basically includes a hose and connected nozzle, motor-driven pump, and inclined sluice box. Overburden and stream water is sucked up through the nozzle and hose in vacuum-like fashion and deposited into an upper end of the sluice box. The overburden is collected in the sluice box by a carpet lining the bottom of the box and by a series of interconnected transverse bars (riffle ladder) atop the carpet. The stream water drains out a lower end portion of the box.

Once the sluice box is filled to a point where it no longer collects the overburden efficiently, the pump is stopped and the sluice box is cleaned out. Typically, the sluice box is cleaned out by first removing the riffle ladder and carpet from the box. Then, with the sluice box inclined at a relatively steep angle and tilted partially on edge, the collected overburden is washed into an open bucket held underneath a lower end of the box. Alternatively, the overburden can be washed or dumped into a sieve, such as the model GSP-1 or GSP-2 sold by D&K Detector Sales, Inc., 13809 S.E. Division, Portland, Oregon 97236, which fits snugly over a shallow gold pan. The carpet is normally cleaned separately by rinsing it with water.

The above approach is deficient in two important respects. First, even with the sluice box tilted on edge, often times a portion of the potentially gold-bearing overburden cleaned from the sluice box misses the bucket or sieve and is lost. Second, it is quite difficult, if not impossible, for a single prospector to lift and tilt the heavy, overburden-laden sluice box on edge, pour water into the box and hold the bucket (or sieve and pan) underneath the box all at the same time. Even with two persons the process is cumbersome. This latter problem is prevalent in all but the smallest and lightest sluice boxes.

Accordingly, there is a need for an apparatus which enables a single prospector easily to clean out sluice boxes of different sizes without losing any of the potentially gold-bearing overburden.

SUMMARY OF THE INVENTION

The present invention fulfills the foregoing needs by providing a trough which receives overburden washed from the sluice box and which is at least as wide as the box. An aperture means defining a plurality of openings in a bottom of the trough serves to classify the overburden by retaining large pieces of overburden within the trough and allowing the remaining pieces to pass through. An engagement means secured to the underside of the trough anchors the trough to a container means which collects the smaller pieces of overburden. The invention also preferably has connecting means for connecting the trough to a lower end portion of the sluice box.

It is therefore one object of the invention to provide a sluice box classifier which virtually eliminates the loss of overburden during cleaning of the sluice box.

Another object of the invention is to provide a classifier which greatly simplifies cleaning of the sluice box.

An additional object of the invention is to provide a classifier which allows a sluice box easily to be cleaned by one person.

Yet another object is to provide an apparatus which eliminates the need for lifting and tilting the sluice box during cleaning.

Still another object is to provide a classifier which can be easily connected to the sluice box.

Other objects and advantages of the invention will become apparent from the following detailed description with reference to the accompanying drawings.

BRIEF DESCRIPTION OF THE DRAWINGS

In the drawings:

FIG. 1 is a perspective view of a sluice box classifier in accordance with the present invention anchored to a container (shown in dashed lines) and attached to a lower end portion of a sluice box (also shown in dashed lines).

FIG. 2 is a vertical cross section taken along line 2—2 of FIG. 1.

FIG. 3 is a vertical cross section taken along line 3—3 of FIG. 1.

DETAILED DESCRIPTION OF A PREFERRED EMBODIMENT

Environment of the Invention

As shown in FIG. 1, a sluice box (shown in dashed lines) of a gold mining dredge has a lower end portion 10 which is attached to a sluice box classifier 14. Classifier 14 filters out the larger pieces of overburden and allows the remaining pieces to pass through into a container means, such as a bucket 18 or the like.

Invention

In accordance with the invention, classifier 14 includes a trough means forming a trough to receive the overburden and wash water from sluice box end portion 10. The trough means includes a wall means comprising a front wall 22, back wall 26 and sidewalls 30 and 34, and a bottom means comprising a center panel 38 and opposite sloping floor panels 42 and 46. The trough means should at least be as wide as end portion 10 to insure that all of the overburden from end portion 10 is deposited into the trough.

A plurality of openings in floor panel 38, such as openings 50*a*, 50*b*, and 50*c* shown in FIGS. 1, 2 and 3 respectively, allows the smaller pieces of overburden and wash water to pass therethrough. The number and spacing of these openings is not critical, but should be such as to allow adequate passage of the smaller pieces into bucket 18. The size of the openings is also not critical, but openings which are too large will make the overburden collected in bucket 18 difficult to pan and openings which are too small will result in a collection of overburden in the trough means which cannot be quickly scanned for gold and discarded. It has been found that circular openings having a 7/16 inch diameter and 5/16 inch spacing work well.

Center panel 38 is generally horizontal but slopes gently downwardly from front wall 22 to back wall 26. Panels 42 and 46 slope upwardly from center panel 38 to sidewalls 30 and 34 respectively. As with panel 38, panels 42 and 46 also slope gently downwardly from front wall 22 to back wall 26. In this way, the trough means is similar to a funnel in that it receives material from a relatively wide sluice box end portion 10 and deposits some of the material into a container which can be much narrower than end portion 10. Moreover, the back of the trough means is deeper than the front so as to minimize the likelihood of overflow when the flow of wash water from end portion 10 is particularly heavy.

A lip means comprising an angle member 54 cooperates with an angle portion 58 of front wall 22 to form a slot which receives end portion 10 of the sluice box. The slot is at about the same pitch as end portion 10 so that the latter will easily slide into the slot.

An engagement means of classifier 14 connects the trough means to bucket 18 and comprises an annular rim 60. Rim 60 is secured, such as by welding, to the underside of the trough means. The rim is preferably sized so that it will snugly grip an upper, inside surface of a standard-size bucket 18, such as one of the five-gallon variety, thereby anchoring bucket 18 to classifier 14. The invention can also be used with relatively large containers by placing the trough means in a resting relationship on the container. Regardless of whether the trough means rests upon or is anchored to the container, as an extra precaution it is desirable to connect rim 60 and the container with flexible cords (not shown).

It will be understood that the sideward sloping of panels 42 and 46 is not critical, but should be sufficiently steep to allow proper funneling of the overburden to panel 38. An incline of 5°–10° relative to a horizontal plane is sufficient. A lesser incline may result in small, light pieces of overburden catching on the side panels. It will also be understood that back wall 26 and sidewalls 30, 34 preferably extend higher than front wall 22 so as to minimize the likelihood of overflow.

Apparatus 14 can be constructed of any sturdy material, such as sheet metal, by using conventional cutting and bending techniques. If sheet metal is used, the parts can be secured to one another by welding.

Operation

After removing the riffle ladder and rolled-up carpet (neither of which are shown) from the sluice box in preparation for cleaning, the lower end portion 10 of the box is connected to the classifier by sliding it within the slot formed by angle member 54 and angle portion 58 of forward wall 22. The sluice box remains in its overburden-collecting position and does not have to be inclined further or tilted on edge. Wash water is poured into the sluice box to wash the overburden into the classifier. The rolled-up carpet is stood on end in the trough means and washed in a similar manner.

Because the trough is wider than the end portion of the sluice box, all of the overburden is washed into the trough and none is lost. Moreover, one person can easily clean out the heavy sluice box because the box does not have to be lifted or tilted and the container does not have to be physically held below the end portion of the box. The overburden collected by the trough can be quickly examined for its gold-bearing potential and then discarded. The overburden collected in bucket 18 can then be panned.

Having illustrated and described the principles of my invention by what is presently a preferred embodiment and several suggested alternatives, it should be apparent to those persons skilled in the art that such embodiments may be modified in arrangement and detail without departing from such principles. I claim as my invention all such modifications as come within the true spirit and scope of the invention as defined by the following claims.

I claim:

1. A classifier for cleaning out a gold dredge sluice box of predetermined width comprising:

trough means forming a trough to receive overburden and wash water from said sluice box, said trough means including base means forming a bottom of said trough and being at least as wide as the width of said sluice box;

aperture means defining a plurality of openings in said base means for filtering out a portion of the overburden deposited into said trough means from said sluice box; and engagement means secured to the underside of said trough means for connecting said trough means to a container means which collects the overburden and wash water passing through said trough means;

said trough means including sluice box connecting means for connecting said trough means to a lower end portion of said sluice box so that all the overburden collected in said sluice box is deposited into said trough means during cleaning of said sluice box;

said trough means including a front wall, said front wall having an angle portion which projects away from said trough means at an angle to a vertical median plane of said trough means;

said connecting means including an angle member secured to said front wall which together with said angle portion forms a slot to receive said lower end portion of said sluice box.

* * * * *